US008262854B2

(12) United States Patent
Uusitalo et al.

(10) Patent No.: US 8,262,854 B2
(45) Date of Patent: Sep. 11, 2012

(54) METHOD FOR RECOVERING HYDROLYSIS PRODUCTS

(75) Inventors: Päivi Uusitalo, Noormarkku (FI); Panu Tikka, Espoo (FI)

(73) Assignee: Metso Paper, Inc., Helsinki (FI)

( * ) Notice: Subject to any disclaimer, the term of this patent is extended or adjusted under 35 U.S.C. 154(b) by 741 days.

(21) Appl. No.: 12/223,605

(22) PCT Filed: Jan. 26, 2007

(86) PCT No.: PCT/FI2007/050044

§ 371 (c)(1),
(2), (4) Date: Apr. 2, 2009

(87) PCT Pub. No.: WO2007/090926

PCT Pub. Date: Aug. 16, 2007

(65) Prior Publication Data

US 2009/0218055 A1 Sep. 3, 2009

(30) Foreign Application Priority Data

Feb. 10, 2006 (FI) ..... 20065104

(51) Int. Cl.
*D21C 3/02* (2006.01)
*D21C 3/04* (2006.01)

(52) U.S. Cl. ..... 162/41; 162/19; 162/57

(58) Field of Classification Search ..... 162/19, 162/41, 42, 57, 233
See application file for complete search history.

(56) References Cited

U.S. PATENT DOCUMENTS

| | | | | |
|---|---|---|---|---|
| 2,801,939 | A | 8/1957 | Hignett et al. | |
| 3,212,933 | A | 10/1965 | Hess et al. | |
| 4,427,584 | A | 1/1984 | LeGrand et al. | |
| 4,436,586 | A | 3/1984 | Elmore | |
| 5,139,617 | A | 8/1992 | Tikka et al. | |
| 5,198,074 | A | 3/1993 | Villavicencio et al. | |
| 5,221,357 | A | 6/1993 | Brink | |
| 5,589,033 | A | 12/1996 | Tikka et al. | |
| 5,676,795 | A | 10/1997 | Wizani et al. | |
| 6,533,896 | B1 | 3/2003 | Tikka et al. | |
| 2004/0060673 | A1 * | 4/2004 | Phillips et al. | 162/22 |
| 2005/0065336 | A1 | 3/2005 | Karstens | |

FOREIGN PATENT DOCUMENTS

| | | | |
|---|---|---|---|
| CA | 1173602 | | 9/1984 |
| WO | WO00/61858 | A | 10/2000 |
| WO | WO01/32715 | A | 5/2001 |
| WO | WO03/046227 | A | 6/2003 |

OTHER PUBLICATIONS

Mar. 3, 2011 applicant response to the EPO.*
Rydholm, S.E., Pulping Processes, p. 649 to 672, Interscience Publishers, New York, 1968.

* cited by examiner

*Primary Examiner* — Anthony Calandra
(74) *Attorney, Agent, or Firm* — Buchanan Ingersoll & Rooney PC

(57) ABSTRACT

An improved method for treating lignocellulosic material, including a prehydrolysis-mass transfer process, which produces a concentrated hydrolysate volume during the time required for the hydrolysis itself. The improved process comprises the heating of the digester and chip content by direct steam to the required hydrolysis temperature, starting a flow of hot, stored hydrolysate to the top of the chip bed in order to create a trickle-bed type down-flow of hydrolysate, collecting a first fraction of the trickled-down hydrolysate as a product fraction, adding extraction liquid and continuing the trickle flow to collect a second hydrolysate fraction, which will be discharged from the digester to a hot hydrolysate storage tank to be used as the first trickle flow liquid in the next batch.

8 Claims, 1 Drawing Sheet

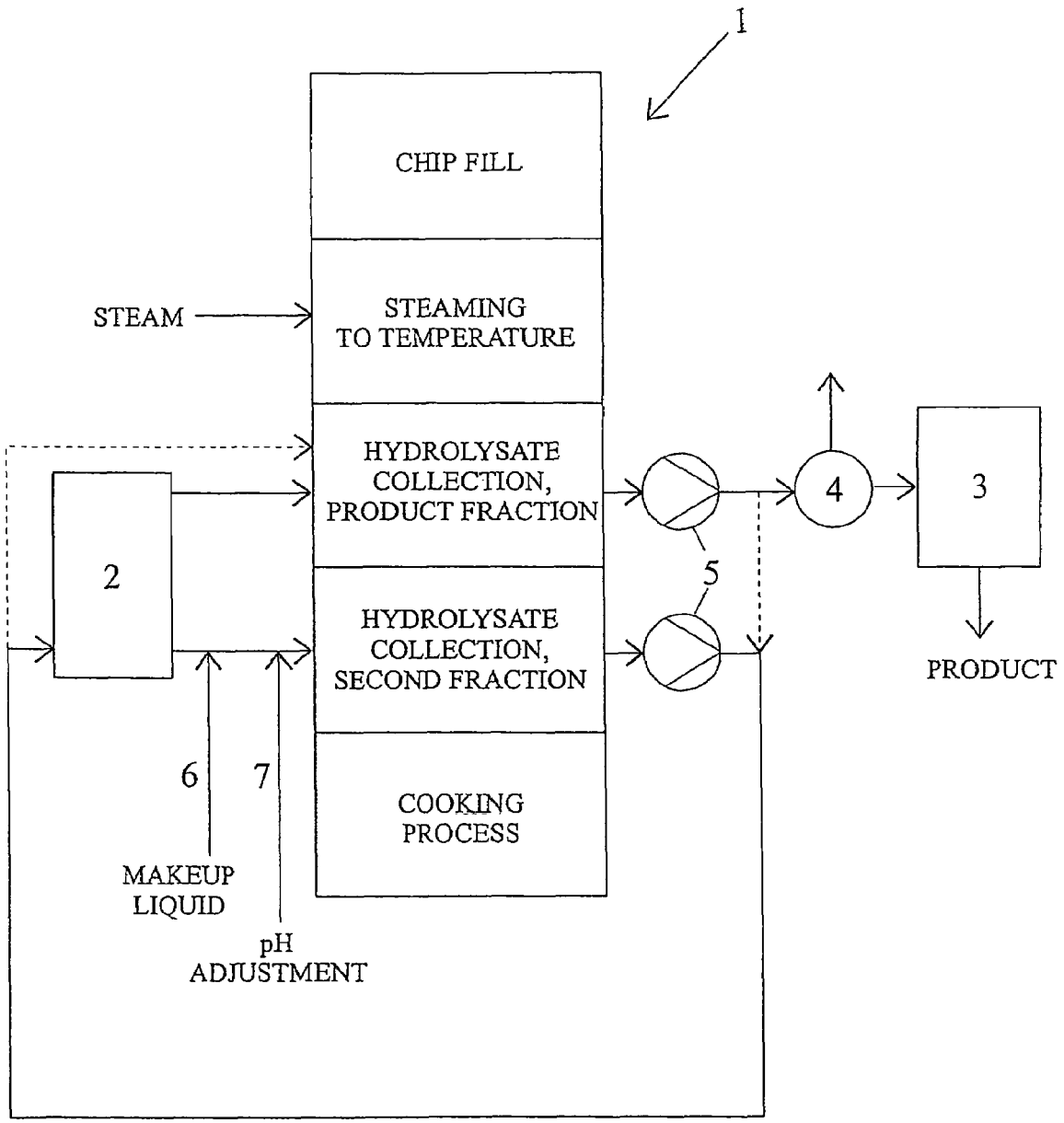
1
CHIP FILL
STEAM
STEAMING
TO TEMPERATURE
HYDROLYSATE
COLLECTION,
PRODUCT FRACTION
2
4
3
5
HYDROLYSATE
COLLECTION,
SECOND FRACTION
PRODUCT
6
7
COOKING
PROCESS
MAKEUP
LIQUID
pH
ADJUSTMENT

METHOD FOR RECOVERING HYDROLYSIS PRODUCTS

FIELD OF THE INVENTION

The invention relates to a method for production of carbohydrates in connection with pulp production. In particular, the invention relates to the recovery of a prehydrolysate product sufficiently concentrated for economically feasible downstream operations.

BACKGROUND OF THE INVENTION

In general, carbohydrates can be produced from lignocellulosic natural materials by hydrolysis of poly- and oligosaccharides. Apart from a total hydrolysis process only leaving a lignin residue, a combination of hydrolysis and cellulose pulp cooking has been developed, called prehydrolysis pulping. The main emphasis has been on the pulp, reflecting the business incentives. In prior art processes, hemicelluloses are hydrolysed into hydrolysate, and lignin is dissolved by a cooking method for liberating cellulose fibers. The produced pulp has a high content of alpha cellulose and can be used e.g. as dissolving pulp.

From a historical perspective, there are two processes for the production of special pulps having a high content of alpha cellulose: the far-extended acidic bisulfite cooking and the prehydrolysis-sulfate (kraft) cooking. The former was developed at the beginning of the 20th century and the latter in the 1930's, see e.g. Rydholm, S. E., Pulping Processes, p. 649 to 672, Interscience Publishers, New York, 1968. The basic idea in both processes is to remove as much hemicellulose as possible from cellulose fibers in connection with the delignification so as to obtain a high content of alpha cellulose. This is essential because the various end uses of such pulps, dissolving pulp for instance, do not tolerate short-chained hemicellulose molecules with a randomly grafted molecular structure. Kraft prehydrolysis pulping processes are disclosed in e.g. Canadian patent application 1,173,602 (Arhippainen et al.) and in U.S. Pat. Nos. 5,589,033 (Tikka and Kovasin), 5,676,795 (Wizani et al.) and 4,436,586 (Elmore).

In the traditional sulfite process, the removal of hemicellulose takes place during the cooking simultaneously with the dissolving of lignin. The cooking conditions are highly acidic and the temperature varies from about 140° C. to 150° C., whereby the hydrolysis is emphasized. The result, however, is always a compromise with delignification. No high content of alpha cellulose is obtained. Another drawback is the decrease in the degree of polymerization of cellulose and yield losses, which also limit the hydrolysis possibilities. In U.S. Pat. No. 5,139,617 (Tikka and Virkola), an anthraquinone—neutral sulfite pulping process is disclosed. Various improvements have been suggested, such as modification of the cooking conditions and even a prehydrolysis step followed by an alkaline sulfite cooking stage.

The utilization of the hydrolyzed carbohydrates released in the prehydrolysis has been neglected and no commercial production based on hydrolysis material has been reported in spite of the fact that this option is mentioned in e.g. the above-referred patents. In today's industrial practice, the hydrolysate is neutralized, combined with the spent cooking liquor, evaporated and combusted in the recovery boiler of the pulp mill's energy and chemicals recovery process.

Looking closer into the reasons of neglecting any other reasonable use of the carbohydrate material uncovers practical problems: The prehydrolysis process step is most practically carried out in steam phase, introducing direct steam to the chip column in the digester. Due to the material and energy balance, very little, if any, liquid hydrolysate phase is generated, as all condensate is trapped in the porosity of the wood material. A separate washing stage using a washing liquid within the digester between the prehydrolysis and the cooking steps takes time, lowers production, is very unfavorable to the energy balance and would produce a very dilute carbohydrate solution requiring further expensive evaporation prior to any reasonable use. Another process possibility has been to carry out the prehydrolysis step in liquid phase. In this case, too, the large amount of liquid and the resulting low concentration of carbohydrates have prevented the development of any reasonable production economy. As a result, the lack of an adequate carbohydrate removal process has precluded the utilization of this renewable raw material of natural origin.

In US patent application 2005/0065336, a pulping process is disclosed, which involves mechanical treatment of wood chips and subjecting of the resulting mass to prehydrolysis using mineral acid treatment and subsequent steaming. After countercurrent washing, good yields of both alfa-cellulose and hemicellulose are reported. The process requires both further comminution of the chips and special process equipment for the hydrolysis and separation operations.

SUMMARY OF THE INVENTION

An object of the present invention is to provide an improved method for treating lignocellulosic material, including a prehydrolysis-mass transfer process, which produces a concentrated hydrolysate volume during the time required for the hydrolysis itself. "Hydrolysate" in this context refers to a liquid phase containing hydrolysis products from the lignocellulosic material. After this low-volume hydrolysate has been discharged from a still hot digester, the process may continue by a neutralization-cooking process known in the art. In accordance with the present invention, the improved process comprises (1) the heating of the digester and chip content by direct steam to the required hydrolysis temperature, (2) starting a flow of hot stored hydrolysate to the top of the chip bed in order to create a trickle-bed type down-flow (hereafter trickle flow) of hydrolysate, (3) collecting a first fraction of the trickled-down hydrolysate as a product fraction, (4) adding extraction liquid and continuing the trickle flow to collect a second hydrolysate fraction, which will be (5) discharged from the digester to a hot hydrolysate storage tank to be used as the first trickle flow liquid in the next batch.

A trickle flow in this context means a downflow of liquid, the volume of which is not sufficient to fill the voids between the chips. As the trickle flow involves a relatively small volume of liquid, it overcomes the problem of dilution. Recirculating part of the hydrolysate to be used as trickle flow medium further increases the product concentration and conserves energy. The problem of lost production time is overcome by starting the trickle flow process phase right after the direct steam heat-up, during the hydrolysis reaction time which is required in any case.

BRIEF DESCRIPTION OF THE DRAWING

FIG. 1 is a diagram of a process according to the invention.

DESCRIPTION OF A PREFERRED EMBODIMENT

In FIG. 1, a process according to the invention is shown, a batch digester and the process stages taking place therein being schematically represented as 1. The chronological stages are presented from the top down, and the various streams entering and leaving the digester are shown in relation to each chronological stage by arrows. After the digester has been filled with lignocellulosic material (here referred to as "chips", although the material may be any lignocellulosic material suitable for prehydrolysis), the process begins with steaming. During this stage, acids from the lignocellulosic material are liberated, lowering the pH significantly without the addition of external chemicals. Hydrolysis of carbohydrates commences, but no significant liquid phase is necessarily formed in the lower part of the digester. The digester and chip temperature at the end of this stage (i.e. the prehydrolysis reaction temperature) may be in the range 150-180° C.; preferably, the chip temperature is about 170° C. A container for a dilute solution of hydrolysis products, hereinafter "dilute hydrolysate", normally originating from an earlier batch, is denoted by the reference numeral 2. When the steaming phase has been completed, i.e. when a pressure increase indicates that the chip column has reached the desired hydrolysis temperature, dilute hydrolysate from container 2 is pumped into the digester, entering through a nozzle arrangement or the like from above the chip column. The nozzle arrangement is designed, according to the knowledge of the skilled person, to provide an even distribution of liquid across the top of the chip column. The dilute hydrolysate, preferably entering at a temperature essentially corresponding to the prehydrolysis reaction temperature, forms a liquid phase not filling the voids between the chips, but trickling uniformly through the chip column towards the digester bottom. Hydrolysis products from the chip column concentrate in this liquid phase, and the liquid, having a higher concentration of hydrolysis products than when entering the digester, is collected at the digester bottom. After a volume sufficient to provide a reasonable liquid level has been collected, the transfer of liquid by means of pump 5 can start. The liquid can be recycled to the top of the digester (as indicated by dotted lines) to continue the trickle flow hydrolysis if a long hydrolysis period is required, or alternatively it can be discharged into concentrated-hydrolysate container 3 (solid lines).

The temperature of the liquid leaving the digester is generally at a temperature above its atmospheric boiling point. Preferably, before entering container 3, the liquid is allowed to flash at 4 against a pressure lower than that corresponding to the boiling point of the liquid. The resulting steam may be used for a subsequent batch.

The liquid volume to be pumped to the container 3 corresponds to the liquid balance of the batch process, i.e. to the sum of volumes of make-up liquid, possible pH adjustment liquid, and water from direct fresh steam heating and from moisture in the lignocellulosic feedstock. The volume of the make-up liquid is determined through the liquid balance of the batch process and eventually by the desired concentration of the hydrolysis product in container 3. When the thus determined volume of concentrated hydrolysate has been recovered into container 3, the extraction of hydrolysate products from the chip column is continued by providing a flow to the top of the column, to continue the trickle flow and the transfer of hydrolysed dissolving material to the liquid. Preferably, the liquid collected at the digester bottom is recycled as shown in FIG. 1. The stream leaving the digester is diverted to pump 5 (using a valve arrangement as known by those skilled in the art), and makeup extraction liquid is provided through line 6. This liquid may be e.g. washing liquid from an optional stage of the process according to the invention (described below), condensate, hot water, evaporation plant condensate, or any available non-alkaline liquid. The recycling is continued to a desired degree of hydrolysis, based e.g on the amount of carbohydrates dissolved. If desired, the pH of the makeup liquid may be adjusted by addition of a hydrolysis agent at 7, e.g. mineral or organic acid, in order to reach a desired final pH in container 2 after the recycling stage. Other useful additives at this point include sulfur dioxide and bisulfite chemicals. Temperature adjustment, preferably using direct steam addition, may be carried out.

When the second trickle flow stage is complete, the cooking process according to the art may start, normally by introducing alkaline cooking liquor. The total duration of the hydrolysis stage is typically in the range 20 to 60 min.

Optionally, when the second trickle flow stage is completed and before the introduction of cooking chemicals, a volume of washing liquid is fed into the digester at one end and recovered at the opposite end. Thus, the volume of washing liquid may be introduced at the top of the digester and discharged at the digester bottom. In the alternative, the volume of washing liquid may be introduced at the digester bottom to be displaced at the top of the digester by the next liquid portion (e.g. cooking liquor) introduced from the bottom.

After passing the digester in this manner, the washing liquid may advantageously be used as makeup liquid in the recycling stage.

The invention claimed is:

1. A method for recovering carbohydrates in a prehydrolysis batch pulping process comprising the following stages:

a) providing a digester having a top and bottom, and containing a column of lignocellulosic material having voids within the column of lignocellulosic material, b) heating the digester and its contents to a predetermined pre-hydrolysis reaction temperature by directly adding steam to the digester, c) providing a flow of hydrolysate liquid at a temperature essentially corresponding to the prehydrolysis reaction temperature and containing hydrolysis product from lignocellulosic material to the top of the column, creating a trickle-bed downflow of hydrolysate liquid wherein the liquid volume of the trickle-bed downflow within the digester facilitates the retention of voids within the column of lignocellulosic material, forming a liquid phase not filling the voids in the lignocellulosic material, but trickling uniformly through the column of lignocellulosic material towards the digester bottom, d) collecting a first fraction of the hydrolysate liquid resulting from said trickle-bed downflow from the digester bottom, e) adding liquid to the flow provided to the top of the column and continuing the trickle-bed downflow wherein the liquid volume of the trickle-bed downflow within the digester facilitates the retention of voids within the column of lignocellulosic material, collecting a second hydrolysate fraction and discharging said second hydrolysate fraction from the digester to a hydrolysate storage tank.

2. The method according to claim 1, wherein the digester and its contents are heated in stage b) to a temperature in the range 150- 180° C.

3. The method according to claim 1, wherein liquid is recycled from the digester bottom discharge to the top of the column in stage c).

4. The method according to claim 1, wherein the liquid is recycled from the digester bottom discharge to the top of the column in stage e).

5. The method according to claim 1, wherein a hydrolysis agent is added to the flow provided to the top of the column in stage e).

6. The method according to claim 1, comprising the additional steps of f) introducing a volume of washing liquid into the digester, and g) removing said volume of washing liquid from the end of the digester opposite to the introduction end.

7. The method according to claim 6, wherein the washing liquid is introduced at the top of the digester.

8. The method according to claim 6, wherein the washing liquid is introduced at the bottom of the digester.

* * * * *